US006948480B2

(12) United States Patent
Eser et al.

(10) Patent No.: US 6,948,480 B2
(45) Date of Patent: Sep. 27, 2005

(54) INJECTION SYSTEM WITH AN EMERGENCY OPERATION FUNCTION AND AN ASSOCIATED EMERGENCY OPERATION METHOD

(75) Inventors: Gerhard Eser, Hemau (DE); Sebastian Pötzel, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/837,769

(22) Filed: May 3, 2004

(65) Prior Publication Data

US 2004/0200456 A1 Oct. 14, 2004

Related U.S. Application Data

(63) Continuation of application No. PCT/DE02/04115, filed on Nov. 6, 2002.

(51) Int. Cl.[7] ..... F02M 37/04
(52) U.S. Cl. ..... 123/495; 123/198 D
(58) Field of Search ..... 123/495, 497, 123/506, 510, 319, 198 D

(56) References Cited

U.S. PATENT DOCUMENTS

| | | | | |
|---|---|---|---|---|
| 4,474,158 | A | 10/1984 | Mowbray | 123/458 |
| 5,937,826 | A | 8/1999 | Olson et al. | 123/447 |
| 6,024,064 | A | 2/2000 | Kato et al. | 123/179.17 |
| 6,253,734 | B1 | 7/2001 | Rembold | 123/446 |

FOREIGN PATENT DOCUMENTS

| | | | |
|---|---|---|---|
| EP | 0 474 168 A1 | 9/1991 | F02M/59/36 |
| WO | WO 00/49283 | 8/2000 | |

*Primary Examiner*—Bibhu Mohanty
(74) *Attorney, Agent, or Firm*—Baker Botts L.L.P.

(57) ABSTRACT

An injection system for an internal combustion engine comprises a pump (1), a pressure accumulator (3), a sensor (7) for detecting the pressure in the pressure accumulator (3), a control valve (2) and a control or regulation unit (8). The control or regulation unit controls the pressure in the pressure accumulator (3) by opening or closing a connection to a low-pressure area (6). The control or regulation unit has an emergency operation function, which operates in such a way that when an error occurs in the regulator circuit, the control valve adopts the open position.

16 Claims, 1 Drawing Sheet

INJECTION SYSTEM WITH AN EMERGENCY OPERATION FUNCTION AND AN ASSOCIATED EMERGENCY OPERATION METHOD

CROSS REFERENCE TO RELATED APPLICATION

This application is a continuation of copending International Application No. PCT/DE02/04115 filed Nov. 6, 2002 which designates the United States, and claims priority to German application no. 101 55 247.5 filed Nov. 9, 2001.

TECHNICAL FIELD OF THE INVENTION

The invention relates to an injection system for internal combustion engines, said system having an emergency operation function, and to a method for maintaining an emergency operation of an injection system of said type.

DESCRIPTION OF THE RELATED ART

In modern internal combustion engines, accumulator injection systems are frequently employed having a pressure accumulator for storing fuel under pressure. The injectors assigned to the internal combustion engine's individual combustion chambers are supplied with fuel from said pressure accumulator. The fuel is ducted to the pressure accumulator via a high-pressure pump connected to the pressure accumulator via a controllable valve, with the valve positioned between the high-pressure pump and pressure accumulator making it possible to adjust the fuel pressure prevailing in the pressure accumulator. The valve can, for example, branch off part of the fuel stream being conveyed by the high-pressure pump and duct it back into a low-pressure area of the injection system when the required fuel pressure has been attained or exceeded. On failure to attain the required fuel pressure in the pressure accumulator, the valve will, by contrast, continue ducting the entire fuel stream being conveyed by the high-pressure pump to the pressure accumulator so that the required pressure level can again be attained in the pressure accumulator as quickly as possible. The valve positioned between the high-pressure pump and pressure accumulator thus allows adjusting of the fuel pressure prevailing in the pressure accumulator so that said valve is driven by a control unit in accordance with the quantity of fuel to be injected.

In hitherto known injection systems the conveying of fuel is halted in the event of a fault in the regulator circuit for regulating the pressure level in the pressure accumulator and operation of the internal combustion engine is terminated. It would, however, be desirable to have an emergency operation function so that the internal combustion engine can continue being operated in emergency mode even in the event of a fault in the regulator circuit for regulating the pressure level in the pressure accumulator.

SUMMARY OF THE INVENTION

The object of the invention is accordingly to provide an injection system for an internal combustion engine which permits an emergency operation and provides a method for maintaining said emergency operation.

Said object can be achieved by means of an injection system for an internal combustion engine, comprising a reciprocating pump, a pressure accumulator, a sensor for detecting the pressure in the pressure accumulator, a control valve, and a control unit or regulation unit, wherein the control unit or regulation unit regulates the pressure in the pressure accumulator by releasing or sealing a passage to a low-pressure area by means of the control valve, the control unit or regulation unit executes an emergency operation in the event of a fault in the regulator circuit, the control valve is positioned between a low-pressure area and the pressure accumulator, said valve is connected to the pressure accumulator via a line, a non-return valve for preventing fuel flowing back from the pressure accumulator is positioned in the line in front of the pressure accumulator, the reciprocating pump is positioned between the control valve and the non-return valve, the control valve includes a valve-closing member which opens a passage proceeding from the low-pressure area in the direction of the pressure accumulator, for an emergency operation the control unit or regulation unit de-energizes a coil of the control valve in the event of a fault in the regulator circuit for regulating the pressure in the pressure accumulator in order to keep the valve-closing member free-moving, and the reciprocating pump builds up pressure in the line on completion of a take-in stroke so that the passage of the control valve is sealed by means of the valve-closing member and fuel is conveyed into the pressure accumulator.

The object can also be achieved by an injection system for an internal combustion engine, comprising a reciprocating pump, a pressure accumulator, a sensor for detecting the pressure in the pressure accumulator, a control valve positioned between a low-pressure area and the pressure accumulator and connected to the pressure accumulator via a line, including a valve-closing member which opens a passage proceeding from the low-pressure area in the direction of the pressure accumulator, a control unit or regulation unit for regulating the pressure in the pressure accumulator by releasing or sealing a passage to a low-pressure area by means of the control valve and for executing an emergency operation in the event of a fault in the regulator circuit, a non-return valve for preventing fuel flowing back from the pressure accumulator positioned in the line in front of the pressure accumulator, wherein the reciprocating pump is positioned between the control valve and the non-return valve, for an emergency operation the control unit or regulation unit de-energizes a coil of the control valve in the event of a fault in the regulator circuit for regulating the pressure in the pressure accumulator in order to keep the valve-closing member free-moving, and the reciprocating pump builds up pressure in the line on completion of a take-in stroke so that the passage of the control valve is sealed by means of the valve-closing member and fuel is conveyed into the pressure accumulator.

In the event of a sensor failure or a short-circuit or a line break or a turn-to-turn short, the valve-closing member of the control valve can be kept free-moving for the emergency operation. Actuation of the control valve can be synchronized with the piston stroke of a pump embodied as a single-piston pump. The reciprocating pump can be embodied as a multi-piston pump. A separate non-return inlet valve can be provided which is connected in parallel with the control valve.

The object can further be achieved by a method for maintaining an emergency operation of an internal combustion engine comprising a control unit or regulation unit and a control valve for regulating a pressure level in a pressure accumulator, wherein the control valve is positioned between a low-pressure area and the pressure accumulator and is connected to the pressure accumulator via a line, wherein a non-return valve for preventing fuel flowing back from the pressure accumulator is positioned in the line in front of the pressure accumulator, wherein the reciprocating pump is positioned between the control valve and the non-return valve, and the control valve includes a valve-closing member which opens a passage proceeding from the low-pressure area in the direction of the pressure accumulator, comprising the step of executing the emergency operation in the event of a fault in the regulator circuit for regulating the pressure in the pressure accumulator in such a way that a coil of the control valve is de-energized so that the valve-closing member is kept free-moving and the reciprocating pump continues being operated so that pressure is built up in the line on completion of a take-in stroke so that the passage of the control valve is sealed by means of the valve-closing member and fuel is conveyed into the pressure accumulator via the non-return valve.

In the absence of a pressure-level signal from the sensor, the value of the pressure in the pressure accumulator can be determined from a characteristics map as a function of the engine speed and of the injected quantity of fuel. Power and speed limitation can also be carried out during emergency operation.

The injection system according to the invention for an internal combustion engine contains a pump, a pressure accumulator, a sensor for detecting the pressure in the pressure accumulator, a control valve positioned between the pump and pressure accumulator, and a control unit or, as the case may be, regulation unit. The control valve can release or, as the case may be, seal a connection to a low-pressure area. The pressure in the pressure accumulator is thus regulated through driving of the control valve by means of the control unit or, as the case may be, regulation unit. The control valve will remain closed if the pressure in the pressure accumulator has not yet attained the required value or, as the case may be, said valve will be opened if the pressure in the pressure accumulator exceeds a pre-defined threshold to allow fuel to be ducted from the high-pressure area into the low-pressure area. The control unit or, as the case may be, regulation unit is embodied in such a way as to open the control valve in the event of a fault in the regulator circuit for regulating the pressure level in the pressure accumulator, thereby ensuring an emergency operation function of the injection system. The pump will continue being operated during emergency operation and hence continue to convey fuel into the pressure accumulator. This conveyed quantity is sufficient to enable emergency operation of the internal combustion engine, despite the opened control valve during emergency operation and hence a connection to the low-pressure area, because the opened control valve functions as a choke. Thus according to the invention the pump will also be driven in the event of a fault in the regulator circuit for pressure-level regulation.

The control valve is preferably embodied as an electrically operated volume control valve. De-energizing of a coil of the electrical volume control valve is especially preferred in the event of a fault so that the volume control valve is opened.

It is advantageous in order to achieve as high as possible pressure during emergency operation for a valve-closing member of the control valve to be embodied in such a way that, proceeding from a low-pressure area, it opens a passage in the direction of the pressure accumulator. In other words the valve-closing member is moved in the intake direction for opening the passage when the pump is taking in the fuel through the control valve.

The control valve is preferably brought into its open position during emergency operation in the event of a sensor failure or a short-circuit or a line break or a turn-to-turn short.

In order to ensure an as simple and compact as possible structural design of the injection system a non-return valve is preferably positioned in front of the pressure accumulator with fuel being taken in through the control valve. The pump in the fluid path is thus positioned between the control valve and non-return valve.

Actuation of the control valve is furthermore preferably synchronized with the piston stroke of a pump embodied as a single-piston pump.

According to a preferred embodiment of the invention there is preferably a separate non-return inlet valve which is connected in parallel with the control valve so that fuel is taken in from the low-pressure area through the non-return inlet valve or both valves.

In keeping with the method according to the invention for maintaining an emergency operation of an internal combustion engine, in the event of a fault in the regulator circuit for regulating the pressure level in a pressure accumulator a control valve which can release or, as the case may be, seal a connection between an output-side area of a pump and a low-pressure area will be opened by a control unit or, as the case may be, regulation unit in the event of a fault in the pressure regulation of the pressure level in the pressure accumulator. Said opening of the control valve in the event of a fault in the regulator circuit facilitates an emergency operation as the pump continues being driven so that it continues to convey fuel into the pressure accumulator. A certain fuel pressure can hereby be built up in the pressure accumulator because the opened control valve functions as a choke and the volumetric flow fed through the pump is, up to a certain pressure level, greater than said rate flowing away through the opened control valve. The level of the pressure built up in the pressure accumulator during emergency operation depends on the quantity of fuel injected by the injectors and on the engine speed. According to the invention it is thus possible for, say, a vehicle to continue driving to a service garage under its own power during emergency operation in the event of a fault.

The method according to the invention is preferably executed in the event of a fault resulting from a short-circuit, a line break or a turn-to-turn short in a valve coil, with the control valve preferably being embodied as a volume-controlled electrically operable valve.

An emergency operation function according to the invention is also possible if the fault is the failure of a sensor for determining the pressure in the pressure accumulator.

A value of the pressure in the pressure accumulator is furthermore preferably determined in the method according to the invention from a characteristics map as a function of the engine speed and the injected quantity of fuel. A pressure value can thus also be obtained even if the pressure sensor fails and can be processed in the control unit or, as the case may be, regulation unit. It is particularly advantageous here for power and speed limitation also to be active during emergency operation, as a consequence of which misfiring can be prevented.

BRIEF DESCRIPTION OF THE DRAWINGS

The invention is described below with the aid of a preferred exemplary embodiment in conjunction with the drawing.

DETAILED DESCRIPTION OF THE PREFERRED EMBODIMENTS

Figure 1:
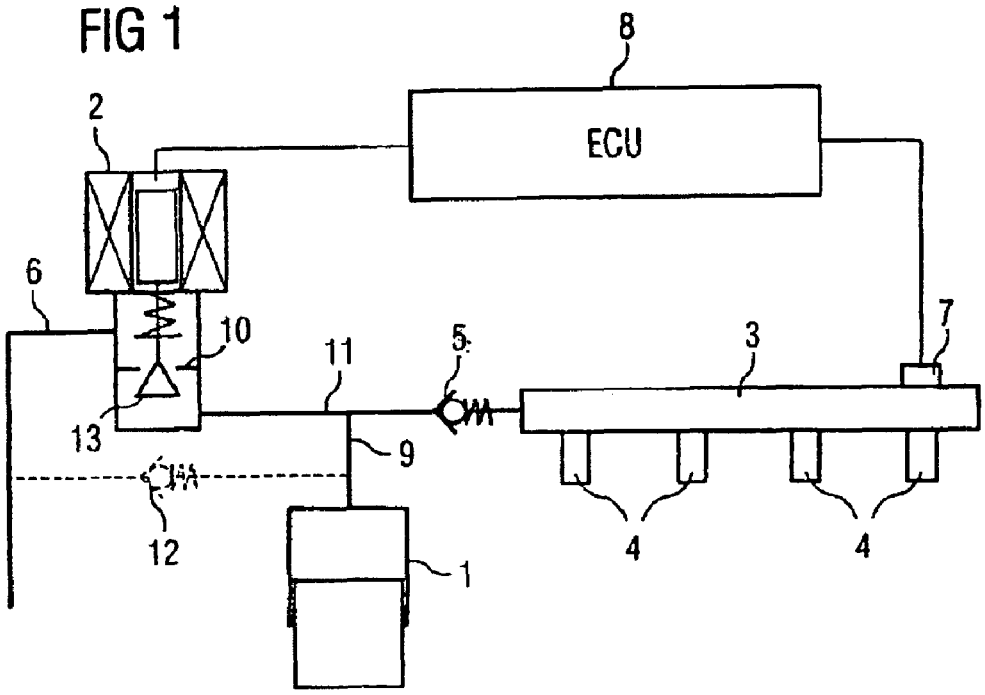
FIG. 1 is a schematic of an injection system according to an exemplary embodiment of the invention.

FIG. 1 is a schematic of the structural design of an injection system according to an exemplary embodiment of the invention. As shown in FIG. 1, the injection system includes a volumetric-flow-controlled high-pressure pump 1 embodied as a single-piston pump. Also provided is a pressure accumulator 3 in which fuel is stored under high pressure and ducted to individual injectors 4 via which fuel is injected into combustion chambers of an internal combustion engine in a known manner. Also provided is a control valve 2 embodied as an electrically operable volume control valve. A pressure sensor 7 for detecting the pressure actually prevailing in the pressure accumulator 3 is provided at the pressure accumulator 3. The injection system also has a control unit or, as the case may be, regulation unit 8 which in particular controls the control valve 2.

The control valve 2 is positioned between a low-pressure area 6 and the pressure accumulator 3 and is connected to the pressure accumulator 3 via a line 11. A non-return valve 5 is also positioned in said line 11 in front of the pressure accumulator 3 to prevent fuel flowing back from the pressure accumulator 3 into the line 11. The pump 1 is hydraulically positioned via a branch line 9 between the control valve 2 and non-return valve 5 (see FIG. 1) and takes in fuel from the low-pressure line 6 through the control valve 2. The pump 1 thus operates as a plunger pump. The control valve 2 is embodied as an outwardly opening valve, which is to say the control valve 2 performs its travel proceeding from the closed valve in the direction of the line 11, and seals or, as the case may be, releases a passage 10 between the low-pressure line 6 and the line 11. That is to say the direction of the opening travel of the control valve 2 is the same as the flow direction of the fuel when being taken in through the control valve.

The functioning mode of the injection system according to the invention is described below. The high-pressure pump 1 takes in fuel from the low-pressure line 6 through the passage 10, which has been opened by the control valve 2. The high-pressure pump being a single-piston pump, driving of the control valve 2 is synchronized with the piston stroke in order to minimize loss. When the fuel has been taken in and the direction of motion of the piston of the reciprocating pump 1 reverses, the control valve 2 seals the passage 10 so that fuel is ducted via the non-return valve 5 into the pressure accumulator 3. The fuel is ducted in a known manner from the pressure accumulator 3 to injectors 4, which inject the fuel into combustion chambers of the internal combustion engine. The aim is for there constantly to be a pre-defined pressure in the pressure accumulator 3. This is registered by means of the pressure sensor 7 which issues relevant signals to the control unit or, as the case may be, regulation unit 8. In keeping with the pressure level prevailing in the pressure accumulator 3, a conveying of fuel through the reciprocating pump is reduced (for example by reducing the drive speed) or halted or, as the case may be, the control valve 2 is appropriately driven and also opened during the pressure stroke of the pump 1 so that fuel flows back from the line 11 to the low-pressure area.

In order to enable an emergency operation of the injection system, the control unit or, as the case may be, regulation unit 8 is embodied such that in the event of a fault in the regulator circuit the control valve 2 is driven in such a way as to be constantly open so as to produce a constant connection between the line 11 and the low-pressure area 6. The control valve 2 being embodied as an electrically operable valve, the open position can be achieved simply by de-energizing the coil of the valve 2.

The control valve 2 furthermore being embodied as an outwardly opening valve, the valve-closing member is free-moving when the coil is de-energized so that the passage 10 will be sealed on completion of the take-in stroke of the reciprocating pump 1 owing to the build-up of pressure in the line 11, and fuel can be conveyed into the pressure accumulator 3 (see FIG. 1). The build-up of pressure in the pressure accumulator 3 during emergency operation will thus continue being supported by the free-moving valve-closing member 13 through sealing of the passage 10 during the pressure stroke, as a consequence of which higher pressures are possible in the pressure accumulator 3.

It should be noted that the fault in the regulator circuit can in particular be in the area of the control valve 2, caused for example by a short-circuit or a line break or a turn-to-turn short in the valve coil, or can be due to a fault in the pressure sensor 7 so that no signals can be supplied from the pressure sensor 7 to the control unit or, as the case may be, regulation unit 8.

Figure 2:
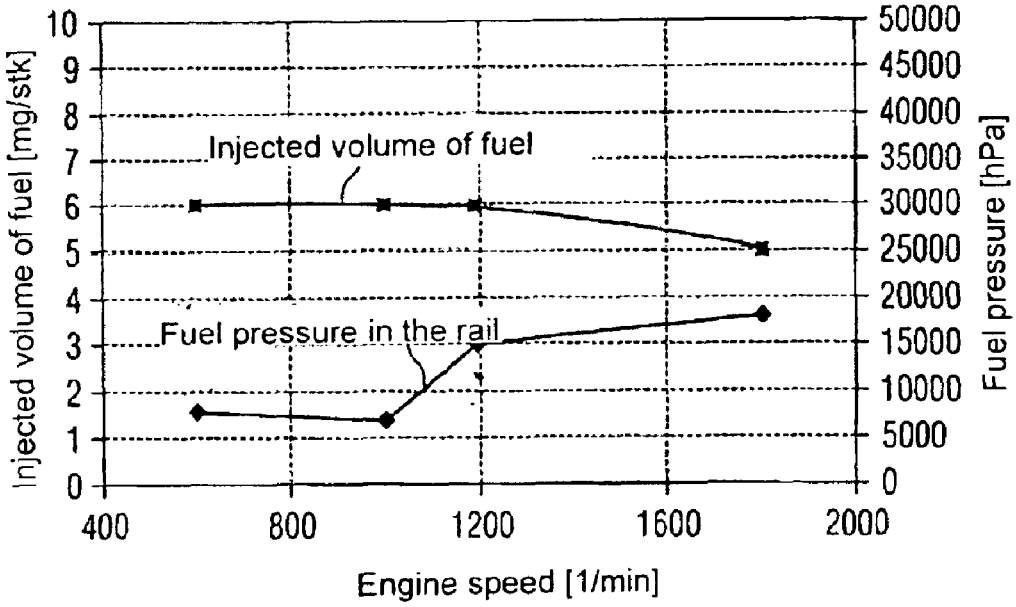
FIG. 2 is a schematic of a characteristics map during emergency operation.

Should the pressure sensor 7 fail, the pressure prevailing in the pressure accumulator 3 during emergency operation can be determined from, for example, a characteristics map, as shown schematically in FIG. 2, as a function of the engine speed and of the quantity of fuel injected by the injectors 4. The value obtained in said manner can accordingly be further processed by the control unit or, as the case may be, regulation unit 8. For this, a characteristics map of said type only needs to be pre-stored in a memory for the control unit or, as the case may be, regulation unit.

According to the invention an injection system with a simply structured emergency operation is hence provided. Said emergency operation can be maintained by embodying the control and regulation unit 8 in such a way as to open the control valve 2 in the event of a fault in the regulator circuit for pressure-level regulation in the pressure accumulator 3. This will enable the pump 1 to nevertheless convey a volumetric flow into the pressure accumulator 3 and even to build up a slight pressure there which will permit emergency operation of the internal combustion engine.

Also shown in FIG. 1, by means of dashed lines, is a further variant of the injection system according to the invention. As shown in FIG. 1, a non-return inlet valve 12 via which the reciprocating pump takes in fuel from the low-pressure area 6 can be provided in parallel with the control valve 2. This means it is no longer necessary to take in fuel through the control valve 2. The control valve 2 can accordingly also be embodied as a valve opening in the direction of the low-pressure area.

It should further be noted that the high-pressure pump can be embodied not only as a single-piston pump and that multi-piston pumps can also be employed.

The invention thus relates to an injection system for an internal combustion engine, said system having a pump 1, a pressure accumulator 3, a sensor 7 for detecting the pressure in the pressure accumulator 3, a control valve 2, and a control unit or, as the case may be, regulation unit 8. The control unit or, as the case may be, regulation unit 8 regulates the pressure in the pressure accumulator 3 by releasing or, as the case may be, sealing a connection to a low-pressure area 6. The control unit or, as the case may be, regulation unit has an emergency operation function operating in such a way that in the event of a fault in the regulator circuit the control valve will adopt its open position.

The invention is not restricted to the exemplary embodiment illustrated here. A number of variations and modifications can be embodied without departing from the scope of the invention.

We claim:

1. An injection system for an internal combustion engine, comprising:

a reciprocating pump, a pressure accumulator, a sensor for detecting the pressure in the pressure accumulator, a control valve, and a control unit or regulation unit, wherein the control unit or regulation unit regulates the pressure in the pressure accumulator by releasing or sealing a passage to a low-pressure area by means of the control valve, the control unit or regulation unit executes an emergency operation in the event of a fault in the regulator circuit, the control valve is positioned between a low-pressure area and the pressure accumulator, said valve is connected to the pressure accumulator via a line, a non-return valve for preventing fuel flowing back from the pressure accumulator is positioned in the line in front of the pressure accumulator, the reciprocating pump is positioned between the control valve and the non-return valve, the control valve includes a valve-closing member which opens a passage proceeding from the low-pressure area in the direction of the pressure accumulator, for an emergency operation the control unit or regulation unit de-energizes a coil of the control valve in the event of a fault in the regulator circuit for regulating the pressure in the pressure accumulator in order to keep the valve-closing member free-moving, and the reciprocating pump builds up pressure in the line on completion of a take-in stroke so that the passage of the control valve is sealed by means of the valve-closing member and fuel is conveyed into the pressure accumulator.

2. The injection system according to claim 1, wherein in the event of a sensor failure or a short-circuit or a line break or a turn-to-turn short, the valve-closing member of the control valve will be kept free-moving for the emergency operation.

3. The injection system according to claim 1, wherein actuation of the control valve is synchronized with the piston stroke of a pump embodied as a single-piston pump.

4. The injection system according to claim 1, wherein the reciprocating pump is embodied as a multi-piston pump.

5. The injection system according to claim 2, wherein the reciprocating pump is embodied as a multi-piston pump.

6. The injection system according to claim 1, wherein a separate non-return inlet valve is provided which is connected in parallel with the control valve.

7. A method for maintaining an emergency operation of an internal combustion engine comprising a control unit or regulation unit and a control valve for regulating a pressure level in a pressure accumulator, wherein the control valve is positioned between a low-pressure area and the pressure accumulator and is connected to the pressure accumulator via a line, wherein a non-return valve for preventing fuel flowing back from the pressure accumulator is positioned in the line in front of the pressure accumulator, wherein the reciprocating pump is positioned between the control valve and the non-return valve, and the control valve includes a valve-closing member which opens a passage proceeding from the low-pressure area in the direction of the pressure accumulator, comprising the step of:

executing the emergency operation in the event of a fault in the regulator circuit for regulating the pressure in the pressure accumulator in such a way that a coil of the control valve is de-energized so that the valve-closing member is kept free-moving and the reciprocating pump continues being operated so that pressure is built up in the line on completion of a take-in stroke so that the passage of the control valve is sealed by means of the valve-closing member and fuel is conveyed into the pressure accumulator via the non-return valve.

8. The method according to claim 7, wherein in the absence of a pressure-level signal from the sensor, the value of the pressure in the pressure accumulator is determined from a characteristics map as a function of the engine speed and of the injected quantity of fuel.

9. The method according to claim 7, wherein power and speed limitation is also carried out during emergency operation.

10. The method according to claim 8, wherein power and speed limitation is also carried out during emergency operation.

11. An injection system for an internal combustion engine, comprising:

a reciprocating pump, a pressure accumulator, a sensor for detecting the pressure in the pressure accumulator, a control valve positioned between a low-pressure area and the pressure accumulator and connected to the pressure accumulator via a line, including a valve-closing member which opens a passage proceeding from the low-pressure area in the direction of the pressure accumulator, a control unit or regulation unit for regulating the pressure in the pressure accumulator by releasing or sealing a passage to a low-pressure area by means of the control valve and for executing an emergency operation in the event of a fault in the regulator circuit, a non-return valve for preventing fuel flowing back from the pressure accumulator positioned in the line in front of the pressure accumulator, wherein the reciprocating pump is positioned between the control valve and the non-return valve, for an emergency operation the control unit or regulation unit de-energizes a coil of the control valve in the event of a fault in the regulator circuit for regulating the pressure in the pressure accumulator in order to keep the valve-closing member free-moving, and the reciprocating pump builds up pressure in the line on completion of a take-in stroke so that the passage of the control valve is sealed by means of the valve-closing member and fuel is conveyed into the pressure accumulator.

12. The injection system according to claim 11, wherein in the event of a sensor failure or a short-circuit or a line break or a turn-to-turn short, the valve-closing member of the control valve will be kept free-moving for the emergency operation.

13. The injection system according to claim 11, wherein actuation of the control valve is synchronized with the piston stroke of a pump embodied as a single-piston pump.

14. The injection system according to claim 11, wherein the reciprocating pump is embodied as a multi-piston pump.

15. The injection system according to claim 12, wherein the reciprocating pump is embodied as a multi-piston pump.

16. The injection system according to claim 11, wherein a separate non-return inlet valve is provided which is connected in parallel with the control valve.

* * * * *

UNITED STATES PATENT AND TRADEMARK OFFICE

CERTIFICATE OF CORRECTION

PATENT NO. : 6,948,480 B2
DATED : September 27, 2005
INVENTOR(S) : Gerhard Eser and Sebastian Pötzel It is certified that error appears in the above-identified patent and that said Letters Patent is hereby corrected as shown below:

Title page,
Insert Item
-- [30] Foreign Application Priority Data:
November 9, 2001 (DE) .....101 55 247 --.

Signed and Sealed this

Fourteenth Day of February, 2006

JON W. DUDAS
*Director of the United States Patent and Trademark Office*